US010902780B2

(12) United States Patent
Kim et al.

(10) Patent No.: US 10,902,780 B2
(45) Date of Patent: Jan. 26, 2021

(54) DISPLAY DEVICE AND METHOD OF DRIVING DISPLAY DEVICE

(71) Applicant: Samsung Display Co., Ltd., Yongin-Si (KR)

(72) Inventors: Jeon Kyoo Kim, Seoul (KR); Oh Jo Kwon, Suwon-si (KR); Jiwoong Kim, Suwon-si (KR); JunYong Song, Hwaseong-si (KR); Dong Won Lee, Suwon-si (KR); Jae Keun Lim, Suwon-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/402,169

(22) Filed: May 2, 2019

(65) Prior Publication Data

US 2020/0090590 A1 Mar. 19, 2020

(30) Foreign Application Priority Data

Sep. 19, 2018 (KR) ..... 10-2018-0111968

(51) Int. Cl.
*G09G 3/3266* (2016.01)
*G09G 3/3258* (2016.01)
*G09G 3/3275* (2016.01)

(52) U.S. Cl.
CPC ..... *G09G 3/3258* (2013.01); *G09G 3/3266* (2013.01); *G09G 3/3275* (2013.01); *G09G 2300/0809* (2013.01); *G09G 2320/0257* (2013.01); *G09G 2330/023* (2013.01); *G09G 2330/028* (2013.01)

(58) Field of Classification Search
CPC .. G09G 3/3258; G09G 3/3266; G09G 3/3275; G09G 2300/0809; G09G 2320/0257; G09G 2330/023; G09G 2330/028
See application file for complete search history.

(56) References Cited

U.S. PATENT DOCUMENTS

2006/0176250 A1* 8/2006 Nathan ..... G09G 3/3233 345/76
2010/0013816 A1* 1/2010 Kwak ..... G09G 3/3233 345/211
2015/0029171 A1* 1/2015 Jo ..... G09G 3/3258 345/212

FOREIGN PATENT DOCUMENTS

KR 10-1152464 B1 6/2012
KR 10-2015-0012022 A 2/2015
KR 10-2015-0069994 A 6/2015
(Continued)

*Primary Examiner* — Towfiq Elahi
(74) *Attorney, Agent, or Firm* — Innovation Counsel LLP

(57) ABSTRACT

A display device includes data lines, scan lines, and pixels. Each of the pixels includes an organic light emitting diode, a first transistor (OLED), and a second transistor. The first transistor is electrically connected to an anode of the OLED. The second transistor is electrically connected to the first transistor, a scan line among the scan lines, and a data line among the data lines. The second transistors of the pixels may receive instances of a reference voltage from the data lines during a first period of a frame. The second transistors of the pixels may simultaneously receive instances of a turn-on scan signal from the scan lines during the first period of the frame. Cathodes of the OLEDs of the pixels may receive instances of a turn-off voltage for the OLEDs to turn off during the first period of the frame.

18 Claims, 9 Drawing Sheets

(56) References Cited

FOREIGN PATENT DOCUMENTS

| | | | |
|---|---|---|---|
| KR | 10-2016-0037637 | A | 4/2016 |
| KR | 10-2018-0005588 | A | 1/2018 |

* cited by examiner

DISPLAY DEVICE AND METHOD OF DRIVING DISPLAY DEVICE

This application claims priority from and the benefit of Korean Patent Application No. 10-2018-0111968 filed on Sep. 19, 2018; the Korean Patent Application is incorporated by reference herein.

BACKGROUND

1. Field

The technical field relates to a display device and a method of driving the display device.

2. Description of the Related Art

Generally, a display device includes a display panel and a display panel driver for driving the display panel. When the display device displays a still image, the display device may operate in a power-saving mode for reducing power consumption.

SUMMARY

Embodiments may be related to a display device that can effectively eliminate an afterimage when switching from a low-power drive mode to a normal drive mode.

Embodiments may be related to a method of driving the display device.

According to an embodiment, there is provided a display device including a display panel comprising a plurality of data lines, a plurality of scan lines and a plurality of pixel circuits, each of the pixel circuits comprising an organic light emitting diode, a first transistor connected to an anode electrode of the organic light emitting diode and a second transistor connected to a scan line, a data line and the first transistor, a data driver configured to provide a reference voltage to the plurality of data lines during a first period of a frame when a drive mode is switched from a low-power drive mode to a normal drive mode, a scan driver configured to simultaneously provide a scan signal of an ON-voltage for turning on the second transistor to the plurality of scan lines during the first period of the frame and a voltage generator configured to apply a second power source voltage of a high level for turning off the organic light emitting diode to a cathode electrode of the organic light emitting diode during the first period of the frame.

In an embodiment, the display panel may further include a plurality of emission lines, and the pixel circuit further includes a third transistor connected to an emission line and the first transistor.

In an embodiment, the display device may further include an emission driver configured to simultaneously provide an emission control signal of an ON-voltage for turning on the third transistor to the plurality of emission lines during the first period of the frame.

In an embodiment, during the active period of the frame, the voltage generator may be configured to provide a second power source voltage of the high level to a cathode electrode of the organic light emitting diode.

In an embodiment, during the second period of the frame, the voltage generator may be configured to provide a second power source voltage of a lower level than the first power source voltage to the cathode electrode of the organic light emitting diode, and the emission driver may be configured to simultaneously provide an emission control signal of an ON-voltage to the plurality of emission lines.

In an embodiment, the first period of the frame may be located before the active period and the second period may be located after the active period.

In an embodiment, when the drive mode may be switched from the low-power drive mode to the normal drive mode, the frame including the first period, the active period and the second period may be repeated during a preset period.

In an embodiment, when the drive mode may be switched from the low-power drive mode to the normal drive mode, one of an odd numbered frame and an even numbered frame may include the first period, the active period and the second period.

In an embodiment, the first and third transistors may be a P-type transistors, and the second transistor may be an N-type transistor.

In an embodiment, the display panel may further include a plurality of sensing lines, and the pixel circuit may further include a fourth transistor connected to the scan line, the anode electrode and the scan line of the organic light emitting diode.

In an embodiment, the fourth transistor may be an N-type transistor.

In an embodiment, the display device may further include a sensing part connected to the sensing lines and generating sensing data by analog-to-digital conversion of the sensing signal transmitted from the sensing line.

According to an embodiment, there is provided a method of driving a display device which includes a plurality of data lines, a plurality of scan lines and a plurality of pixel circuits, each of the pixel circuits comprising an organic light emitting diode, a first transistor connected to an anode electrode of the organic light emitting diode and a second transistor connected to a scan line, a data line and the first transistor. The method includes providing a reference voltage to the plurality of data lines during a first period of a frame when a drive mode is switched from a low-power drive mode to a normal drive mode, simultaneously providing a scan signal of an ON-voltage for turning on the second transistor to the plurality of scan lines during the first period of the frame, and applying a second power source voltage of a high level for turning off the organic light emitting diode to a cathode electrode of the organic light emitting diode during the first period of the frame.

In an embodiment, the display device may further include a plurality of emission lines, and the pixel circuit may further include a third transistor connected to an emission line and the first transistor, wherein in a first period of the frame, the emission driver is configured to simultaneously provide an emission control signal of an ON-voltage for turning on the third transistor to the plurality of emission lines.

In an embodiment, the method may further include during the active period of the frame, providing a second power source voltage of the high level to a cathode electrode of the organic light emitting diode.

In an embodiment, the method may further include during the second period of the frame, providing a second power source voltage of a lower level than the first power source voltage to the cathode electrode of the organic light emitting diode, and simultaneously providing an emission control signal of an ON-voltage to the plurality of emission lines.

In an embodiment, the first period of the frame may be located before the active period and the second period may be located after the active period.

In an embodiment, when the drive mode may be switched from the low-power drive mode to the normal drive mode, the frame including the first period, the active period and the second period may be repeated during a preset period.

In an embodiment, when the drive mode may be switched from the low-power drive mode to the normal drive mode, one of an odd numbered frame and an even numbered frame may include the first period, the active period and the second period.

In an embodiment, the first and third transistors may be a P-type transistors, and the second transistor may be an N-type transistor.

A display device may include a plurality of data lines, a plurality of scan lines, and a plurality of pixel circuits. The plurality of scan lines may be electrically insulated from the plurality of data lines. Each of the pixel circuits may include an organic light emitting diode, a first transistor, and a second transistor. The first transistor may be electrically connected to an anode electrode of the organic light emitting diode. The second transistor may be electrically connected to the first transistor, a scan line among the scan lines, and a data line among the data lines. The second transistors of the pixel circuits may respectively receive instances of a reference voltage from the plurality of data lines during a first period of a frame. The second transistors of the pixel circuits may respectively and simultaneously receive instances of a turn-on scan signal from the plurality of scan lines and turn on during the first period of the frame. Cathode electrodes of the organic light emitting diodes of the pixel circuits may respectively receive instances of a turn-off voltage and for the organic light emitting diodes of the pixel circuits to turn off during the first period of the frame.

The display device may include a plurality of emission lines. Each of the pixel circuits may further include a third transistor electrically connected to the first transistor and an emission line among the emission lines.

The third transistors of the pixel circuits may respectively and simultaneously receive instances of a turn-on emission control signal from the plurality of emission lines and turn on during the first period of the frame.

An active period of the frame may immediately follow the first period of the frame. The second transistors of the pixel circuits may respectively receive data voltages from the plurality of data lines during the active period of the frame. At least one the data voltages may be unequal to the reference voltage. The cathode electrodes of the organic light emitting diodes of the pixel circuits may respectively continue receiving the instances of the turn-off voltage and remain turned off during the active period of the frame.

A light-emitting period of the frame immediately may follow the active period of the frame. The cathode electrodes of the organic light emitting diodes of the pixel circuits may respectively receive instances of a turn-on voltage during the light-emitting period. The third transistors of the pixel circuits may respectively and simultaneously receive further instances of the turn-on emission control signal from the plurality of emission lines during the light-emitting period.

At least one of the first period of the frame and the light-emitting period of the frame may be shorter than the active period of the frame.

The display device may operate in an afterimage removal mode for a preset period after operating in a power-saving drive mode and before operating in a normal drive mode. Power consumption of the display device in the power-saving drive mode may be lower than power consumption of the display device in the normal drive mode. Operations of the frame may be repeated for frames during the preset period.

The display device may operate in an afterimage removal mode for a preset period after operating in a power-saving drive mode. Power consumption of the display device in the power-saving drive mode may be lower than power consumption of the display device in a normal drive mode. Operations of the frame may be repeated for one of odd-numbered frames and even-numbered frames during the preset period. At least some operations of the frame may be not performed for the other of the odd-numbered frames and the even-numbered frames during the preset period.

The first transistor and the third transistor may be P-type transistors. The second transistor may be an N-type transistor.

The display device may include a plurality of sensing lines. Each of the pixel circuits may further include a fourth transistor electrically connected to the anode electrode of the organic light emitting diode and a sensing line among the sensing lines.

The fourth transistor may be an N-type transistor.

The display device may further include a sensing part electrically connected to the sensing lines and generating sensing data by analog-to-digital conversion of sensing signals transmitted from the sensing lines.

An embodiment may be related to a method of driving a display device. The display device may include a plurality of data lines, a plurality of scan lines, and a plurality of pixel circuits. Each of the pixel circuits may include an organic light emitting diode, a first transistor, and a second transistor. The method may include the following steps: providing instances of a reference voltage through the plurality of data lines to the second transistors of the pixel circuits during a first period of a frame; simultaneously providing instances of a turn-on scan signal through the plurality of scan lines to the second transistors of the pixel circuits to turn on the second transistors of the pixel circuits during the first period of the frame; and applying instances of a turn-off voltage to cathode electrodes of the organic light emitting diodes of the pixel circuits to turn off the organic light emitting diodes of the pixel circuits during the first period of the frame.

The display device may further include a plurality of emission lines. Each of the pixel circuits may further include a third transistor electrically connected to the first transistor and an emission line among the emission lines. The method may further include simultaneously providing instances of a turn-on emission control signal through the plurality of emission lines to the third transistors of the pixel circuits to turn on the third transistors of the pixel circuits during the first period of the frame.

The method of may further include the following steps: providing data voltages through the plurality of data lines to the second transistors during an active period of the frame, wherein the active period immediately follows the first period, and wherein at least one the data voltages may be unequal to the reference voltage; and providing the instances of the turn-off voltages to the cathode electrode of the organic light emitting diodes of the pixel circuits during the active period of the frame.

The method may further include the following steps: providing instances of a turn-on voltage to the cathode electrodes of the organic light emitting diodes of the pixel circuits during a light-emitting period of the frame, wherein the light-emitting period of the frame immediately follows the active period of the frame; and simultaneously providing instances of a turn-on emission control signal through the plurality of emission lines to the third transistors of the pixel circuits.

At least one of the first period of the frame and the light-emitting period of the frame may be shorter than the active period of the frame.

The display device may operate in an afterimage removal mode for a preset period after operating in a power-saving drive mode and before operating in a normal drive mode. Power consumption of the display device in the power-saving drive mode may be lower than power consumption of the display device in the normal drive mode. Operations of the frame may be repeated for frames during the preset period.

The display device may operate in an afterimage removal mode for a preset period after operating in a power-saving drive mode. Power consumption of the display device in the power-saving drive mode may be lower than power consumption of the display device in a normal drive mode. Operations of the frame may be repeated for one of odd-numbered frames and even-numbered frames during the preset period. At least some operations of the frame may be not performed for the other of the odd-numbered frames and the even-numbered frames during the preset period.

The first transistor and the third transistor may be P-type transistors. The second transistor may be an N-type transistor.

According to embodiments, an afterimage may be eliminated by initializing a threshold voltage and applying the simultaneous light-emitting mode when the drive mode of a display device is switched from a low-power drive mode to a normal drive mode.

DETAILED DESCRIPTION

Example embodiments are explained with reference to the accompanying drawings. Although the terms "first," "second," etc. may be used herein to describe various elements, these elements, should not be limited by these terms. These terms may be used to distinguish one element from another element. Thus, a first element may be termed a second element without departing from teachings of one or more embodiments. The description of an element as a "first" element may not require or imply the presence of a second element or other elements. The terms "first," "second," etc. may also be used herein to differentiate different categories or sets of elements. For conciseness, the terms "first," "second," etc. may represent "first-type (or first-set)," "second-type (or second-set)," etc., respectively. The term "connect" may mean "electrically connect."

Figure 1:
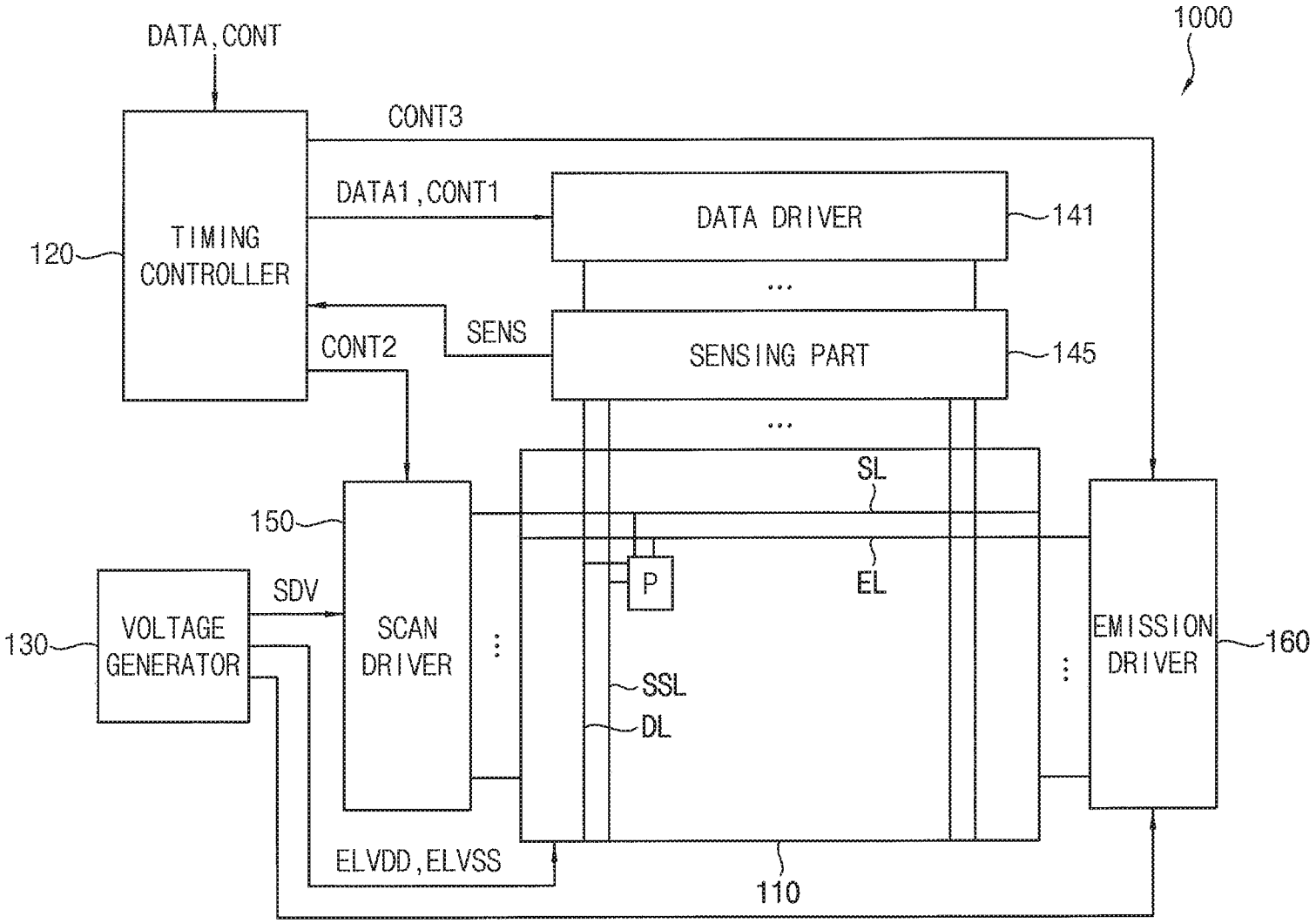
FIG. 1 is a block diagram illustrating a display device according to one embodiment.

FIG. 1 is a block diagram illustrating a display device according to one embodiment.

Referring to FIG. 1, the display device may include a display panel 110, a timing controller 120, a voltage generator 130, a data driver 141, a sensing part 145, a scan driver 150, and an emission driver 160, each including hardware, e.g., electric circuits.

The display panel 110 may include a plurality of pixels P, a plurality of data lines DL, a plurality of sensing lines SSL, a plurality of scan lines SL and a plurality of emission control line EL. The pixels P may be arranged as a matrix/array which includes a plurality of pixel rows and a plurality of pixel columns. Each of the pixels P may include an organic light emitting diode, a plurality of transistors, and at least one capacitor for driving the organic light emitting diode. The pixel P may be connected to a data line DL, a sensing line SSL, a scan line SL, and an emission control line EL.

According to an embodiment, the pixel P may include a transistor of a first type and a transistor of a second type that is different from the first type. For example, the first type of transistor may be a polysilicon thin film transistor. For example, the first type of transistor may be a low temperature polysilicon thin film transistor (LTPS). For example, the second type of transistor may be an oxide thin film transistor. For example, the first type of transistor may be a P-type transistor and the second type of transistor may be an N-type transistor.

The data line DL is connected to the data driver 141 to transmit a data voltage to the pixel P.

The sensing line SSL is connected to the sensing part 145 and transmits a sensing signal sensed at the pixel P to the sensing part 145.

The scan line SL is connected to the scan driver 150 to transmit a scan signal to the pixels P.

The emission control line EL is connected to the emission driver 160 and transmits an emission control signal to the pixel P.

The timing controller 120 may control the overall drive mode of the display device 1000. The timing controller 120 receives an image signal DATA and a control signal CONT from an external device. The image signal DATA1 may include red, green and blue data. The control signal CONT may include a horizontal synchronization signal Hsync, a horizontal synchronization signal Vsync, and a main clock signal MCLK.

The timing controller 120 converts the image signal DATA in accordance with specifications such as pixel structure and a resolution of the display panel 110, and outputs image data DATA1 obtained by correcting the image signal through various correction algorithms.

The timing controller 120 generates a first control signal CONT1 for driving the data driver 141, a second control signal CONT2 for driving the scan driver 150, and a third control signal CONT3 for driving the emission driver 160 based on the control signal CONT.

The voltage generator 130 generates a plurality of driving voltages using an external voltage. The plurality of driving voltages s include a scan driving voltage SDV provided to the scan driver 150, a light emitting driving voltage EDV provided to the emission driver 160, and a plurality of power source voltages ELVDD and ELVSS provided to the display panel 110. The scan drive voltage SDV may include a scan ON-voltage and a scan OFF-voltage. The emission drive voltage EDV may include an emission ON-voltage and an emission OFF-voltage. The plurality of power source voltages may include a first power source voltage ELVDD and a second power source voltage ELVSS for driving the organic light emitting diodes of the display panel 110.

According to an embodiment, the plurality of power source voltages may further include a high level second power source voltage ELVSS_H.

The data driver 141 converts the image data DATA1 into a data voltage in response to the first control signal CONT1 and outputs the data voltage to the data lines DL.

The sensing part 145 may provide the timing controller 120 with sensing data obtained by analog-to-digital conversion of a sensing signal SENS sensed from the pixels P during a sensing period. The timing controller 120 may correct the image data using the sensing data.

The scan driver 150 generates a plurality of scan signals in response to the second control signal CONT2. The second control signal CONT2 may include a scan start signal and at least one clock signal.

The emission driver 160 generates a plurality of emission control signals in response to the third control signal CONT3. The third control signal CONT3 may include an emission start signal and at least one clock signal.

According to an embodiment, the display device 1000 may be driven in a normal drive mode, a low-power drive mode (with lower power consumption than the normal drive mode), and an afterimage removal mode.

In the normal drive mode, the display device displays a normal image on the display panel 110 with a panel drive frequency of, for example, 120 Hz.

In the low-power drive mode, when the image displayed on the display panel 110 is a still image, or when the display panel 110 operates in the always-on mode, the display device displays frame images at one or more low frequencies (e.g., lower than 120 Hz) on the display panel 110, in order to reduce power consumption.

In the afterimage removal mode, when the drive mode is switched from the low-power drive mode to the normal drive mode, the display device drives the display panel 110 to remove an instantaneous afterimage corresponding to the still image of the low-power drive mode.

A frame period of the afterimage removal mode may include an initialization period for initializing a threshold voltage, an active period for writing a (normal) image to the display panel 110, and a simultaneous light-emitting period for simultaneously emitting a plurality of horizontal lines/rows of the display panel 110.

Figure 2:
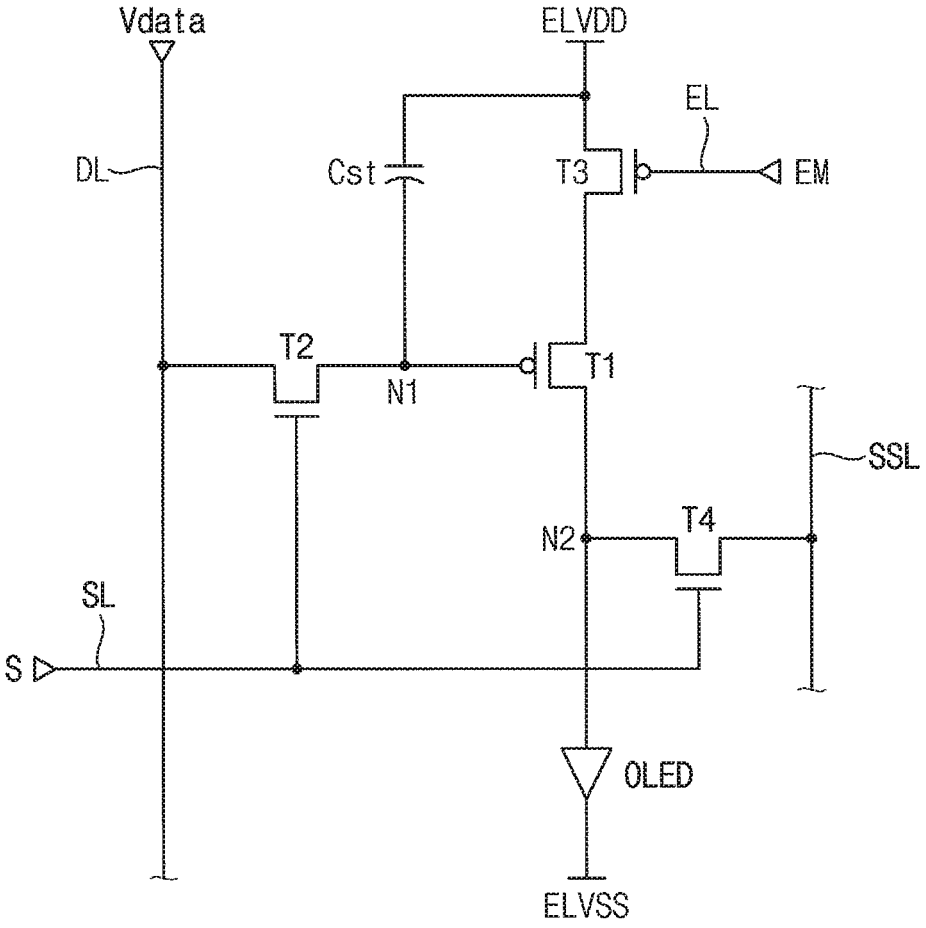
FIG. 2 is an equivalent circuit diagram illustrating a pixel circuit of the display device shown in FIG. 1 according to one embodiment.

FIG. 2 is an equivalent circuit diagram illustrating a pixel circuit of the display device shown in FIG. 1 according to one embodiment.

Referring to FIGS. 1 and 2, the pixel P may include a pixel circuit.

The pixel circuit may include a first transistor T1, a second transistor T2, a third transistor T3, a storage capacitor Cst, an organic light emitting diode OLED and a fourth transistor T4.

The first transistor T1 may be a polysilicon thin film transistor. The first transistor T1 may be a P-type thin film transistor. The first transistor T1 may include a control electrode connected to a first node N1, a first electrode connected to the third transistor T3 and a second electrode connected to a second node N2.

The second transistor T2 may be an oxide thin film transistor. The second transistor T2 may be an N-type thin film transistor. The second transistor T2 includes a control electrode connected to the scan line SL, a first electrode connected to the data line DL, and a second electrode connected to the first node N1.

The third transistor T3 may be the polysilicon thin film transistor. The third transistor T3 may be the P-type thin film transistor. The third transistor T3 may be the P-type thin film transistor. The third transistor T3 includes a control electrode connected to the emission line EL, a first electrode receiving the first power source voltage ELVDD and a second electrode connected to the first electrode of the first transistor T1.

The storage capacitor Cst includes a first electrode connected to the first node N1 and a second electrode receiving the first power source voltage ELVDD.

The organic light emitting diode OLED includes a first electrode connected to the second electrode of the first transistor T1 and a second electrode receiving the second power source voltage ELVSS.

The fourth transistor T4 may be the oxide thin film transistor. The fourth transistor T4 may be the N-type thin film transistor. The fourth transistor T4 includes a control electrode connected to the scan line SL, a first electrode connected to the second node N2 and a second electrode connected to the SSL.

In a method of displaying an image on the pixel circuit, when the data voltage Vdata is applied to the data line DL, and when the ON-voltage of the scan signal S is applied to the control electrode of the second transistor T2, the second transistor T2 is turned on, and the data voltage Vdata is applied to the first node N1. The second transistor T2 is an N-type transistor, and thus the high level may be an ON-voltage. The data voltage Vdata applied to the first node N1 is applied to the storage capacitor Cst.

The data voltage Vdata applied to the first node N1 is applied to the control electrode of the first transistor T1.

When the ON-voltage of the emission control signal EM is applied to the third transistor T3, the third transistor T3 is turned on, and a current flows between the first power source ELVDD and the second power source ELVSS. The third transistor T3 is a P-type transistor, and thus the low level may be an ON-voltage.

The first transistor T1 is turned on based on the data voltage Vdata stored in the storage capacitor Cst, and the driving current according to the gate/source voltage Vgs of the first transistor T1 is applied to the anode electrode of the organic light emitting diode OLED.

Accordingly, the organic light emitting diode OLED may generate light of a grayscale corresponding to the data voltage Vdata by a driving current corresponding to the data voltage Vdata.

In a method of sensing at the pixel circuit, the pixel circuit forms a sensing signal on the pixel circuit during the sensing period and transmits the sensing signal to the sensing part 145 through the sensing line SSL.

The sensing period may be preset to a power-off period of the display device or a vertical blank period of an image display period.

The reference voltage for forming the sensing signal during the sensing period is applied to the data line DL, and the ON-voltage of the scan signal is applied to the second transistor T2 and the fourth transistor T4.

The second and fourth transistors T2 and T4 are N-type transistors, and thus a high level is an ON-voltage.

When the second transistor T2 is turned on, the reference voltage is applied to the first node N1, and the first transistor T1 is turned on based on the reference voltage. The driving current according to the gate/source voltage of the first transistor T1 flows to the anode electrode of the organic light emitting diode OLED, that is, the second node N2. The fourth transistor T4 is turned on and the sensing signal applied to the anode electrode of the organic light emitting diode OLED is transmitted to the sensing part 145 disposed outside the display panel 110 through the sensing line SSL.

Figure 3:
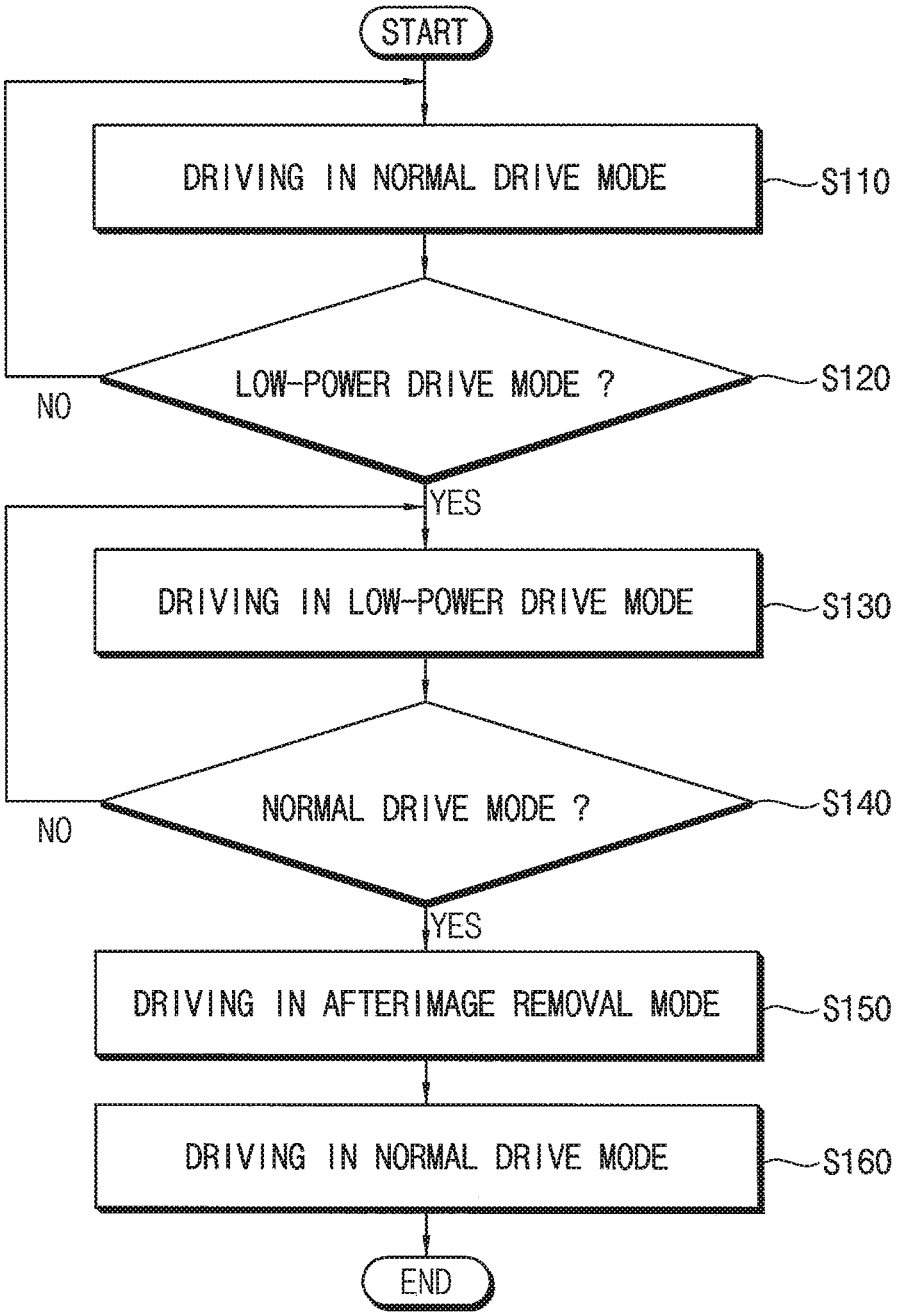
FIG. 3 is a flowchart illustrating a method of driving a display device according to one embodiment.
Figure 4A:
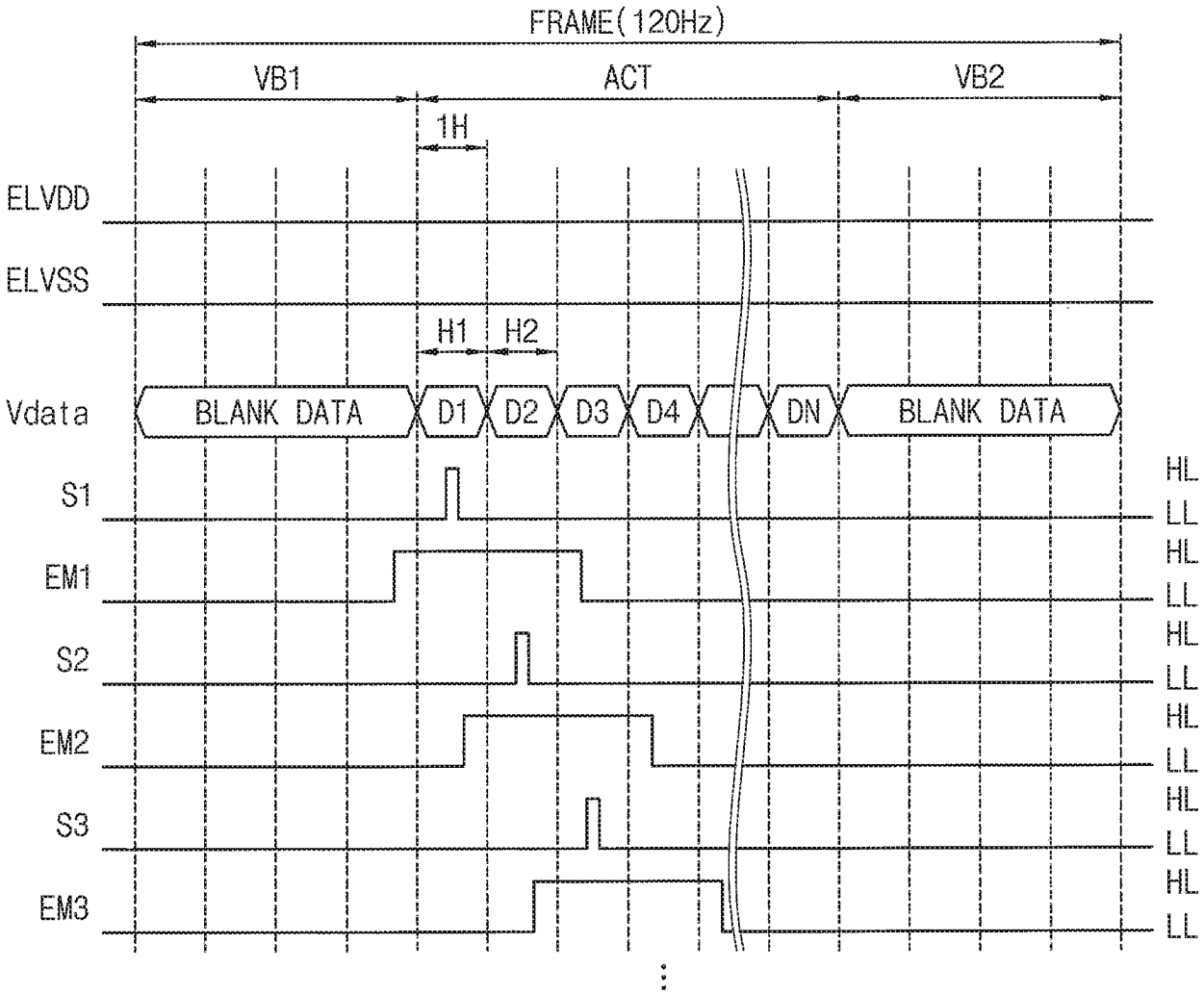
FIG. 4A, FIG. 4B, and FIG. 4C are waveform diagrams illustrating a method of driving a display device according to one embodiment.
Figure 4B:
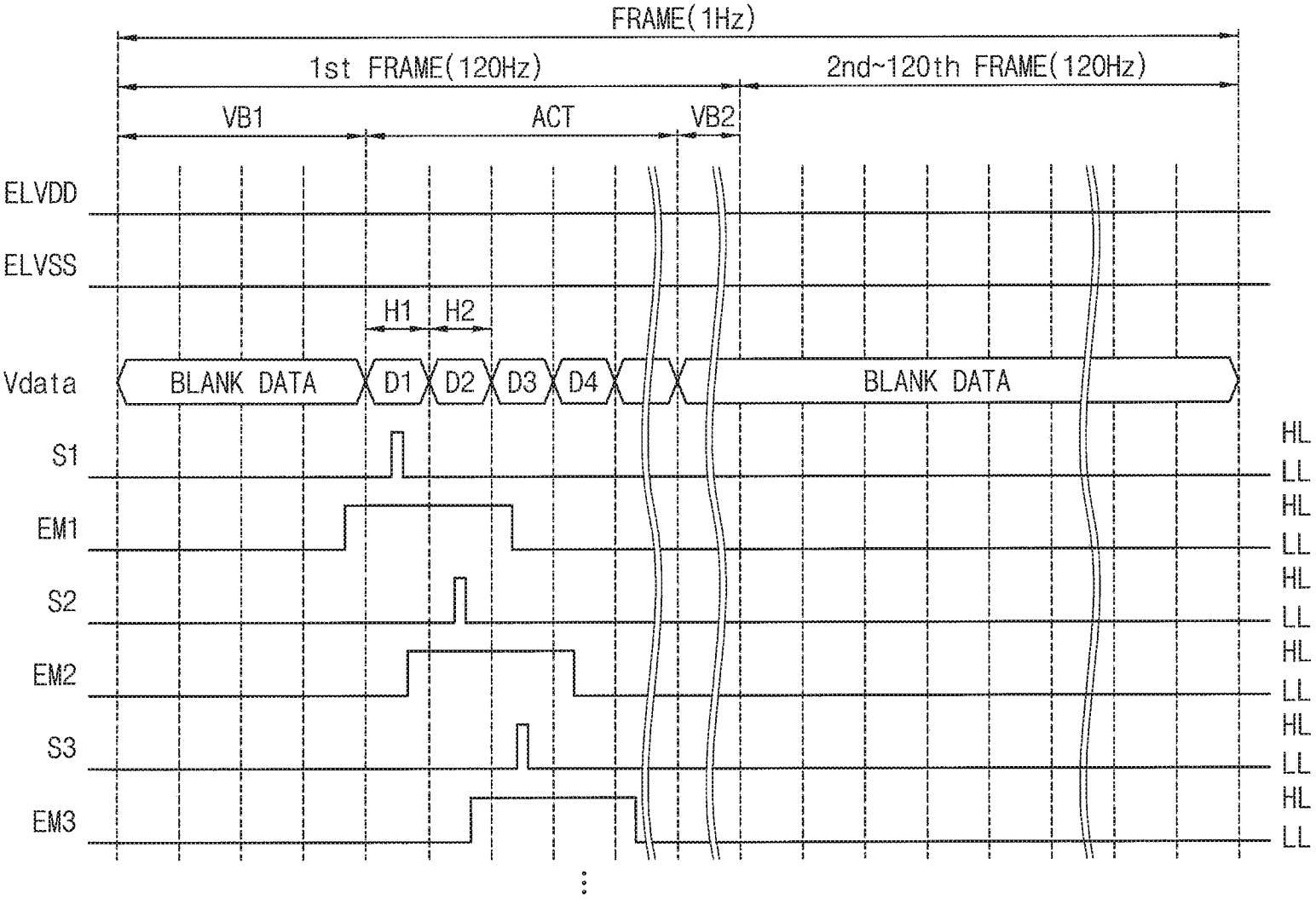
Figure 4C:
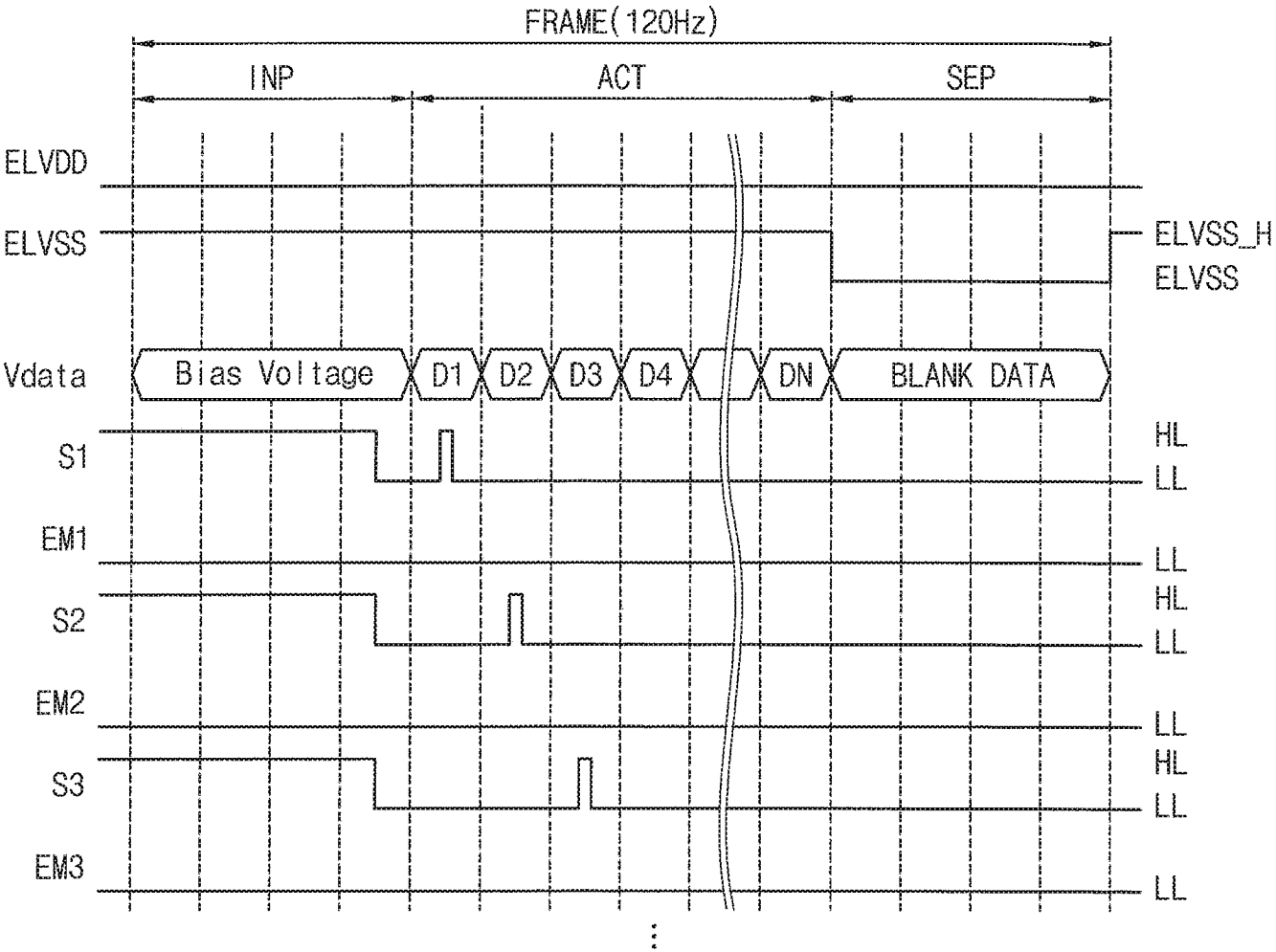

FIG. 3 is a flowchart diagram illustrating a method of driving a display device according to one embodiment. FIGS. 4A to 4C are waveform diagrams illustrating a method of driving a display device according to one embodiment.

Referring to FIGS. 1, 2, 3, and 4A, the timing controller 120 drives the data driver 141, the scan driver 150, and the emission driver 160 at a panel drive frequency in a normal drive mode to display a normal image on the display panel 110 (Step S110). The panel drive frequency is, for example, 120 Hz.

The frame period of the normal drive mode includes the active period ACT, in which data voltages are provided to the display panel, and at least one vertical blank period VB1 and VB2, in which no data voltage is provided to the display panel.

The data driver 141 outputs data voltages D1, D2, D3, . . . , DN for a horizontal line (e.g., a pixel row) in the active period ACT by a horizontal period and does not output a data voltage during the vertical blank period VB1 and VB2. Where 'N' is the number of horizontal lines (i.e., the number of pixel rows) of the display panel.

The scan driver 150 outputs a scan signal S1, S2, S3, . . . , having an ON-voltage HL corresponding to the horizontal period 1H outputting the data voltage of the horizontal line from the data driver 141 and an OFF-voltage LL in the remaining period/time of the frame. The ON-voltage HL of the scan signal has a high level to turn on the second and fourth transistors T2 and T4, which are N-type transistors of the pixel circuit. The ON period of the scan signal with the ON-voltage HL may be less than or equal to the horizontal period 1H.

The emission driver 160 outputs an emission control signal EM1, EM2, EM3, . . . having an OFF-voltage HL corresponding to the horizontal period 1H in which the data voltage of the horizontal line is output from the data driver 141, and an ON-voltage LL during the remaining period/time of the frame. The ON-voltage LL of the emission control signal has a low level to turn on the third transistor T3 which is the P-type transistor of the pixel circuit, and the OFF-voltage of the emission control signal has a high level to turn off the third transistor T3. An ON period of the emission control signal with the ON-voltage LL may be longer than the horizontal period 1H.

As shown in FIG. 4A, in a first horizontal period H1, the data voltage D1 of the first horizontal line is outputted, the ON-voltage HL of the first scan signal S1 corresponding to the first horizontal line is outputted, and the OFF-voltage HL of the first emission control signal EM1 is outputted. Accordingly, the pixel circuit is applied with a data voltage to the control electrode of the first transistor T1. When the ON-voltage LL of the first emission control signal EM1 is outputted, the first transistor T1 is turned on based on the data voltage, and the driving current is applied to the organic light emitting diode OLED. Thus, the first horizontal line emits light.

Then, the data voltage D2 of the second horizontal line is output, the ON-voltage HL of the second scan signal S2 corresponding to the second horizontal line is outputted, and the OFF-voltage HL of the second emission control signal EM2 is outputted. Accordingly, the pixel circuit is applied with a data voltage to the control electrode of the first transistor T1. When the ON-voltage LL of the second emission control signal EM2 is outputted, the first transistor T1 is turned on based on the data voltage, and the driving current is applied to the organic light emitting diode OLED. Therefore, the second horizontal line emits light.

As described above, in the normal drive mode, the plurality of horizontal lines of the display panel 110 may display a normal image with a sequential light emitting mode, in which the display device sequentially emits light.

When the drive mode of the display device is switched to the low-power drive mode to conserve power (Step S120), the display device displays a standby image on the display panel 110 (Step S130). The standby image includes images such as a still image, a clock image, a weather image, etc. that have little or infrequent change.

Referring to FIG. 4B, in the low-power drive mode, during a first frame period 1st Frame with 120 Hz of the panel drive frequency, the data driver 141, the scan driver 150, and the emission driver 160 display a standby image on the display panel 110 with a sequential light emitting mode.

For example, in the first frame period 1st Frame, the data driver 141 outputs the data voltages D1, D2, D3, . . . , DN for a horizontal line by every horizontal period during the active period ACT, and does not output a data voltage during the vertical blank periods VB1 and VB2.

The scan driver 150 outputs scan signals S1, S2, S3, . . . , having an ON-voltage HL corresponding to a horizontal period 1H outputting the data voltage of the horizontal line from the data driver 141 and an OFF-voltage LL in the remaining period/time of the frame.

The emission driver 160 outputs emission control signal EM1, EM2, EM3, . . . , having an OFF-voltage HL corresponding to the horizontal period 1H, in which the data voltage of the horizontal line is output from the data driver 141, and an ON-voltage LL in the remaining period/time of the frame.

In the first frame period 1st Frame, the plurality of horizontal lines of the display panel 110 may sequentially display the standby image with a sequential light emitting mode.

Second to 120-th frame periods (for example, a 2nd Frame) with the panel drive frequency, for example, 120 Hz, the timing controller 120 drives the data driver 141, the scan driver 150, and the emission driver 160 to maintain the standby image displayed on the display panel 110.

For example, the data driver 141 does not output a data voltage, the scan driver 150 outputs an OFF-voltage LL of a scan signal, and the emission driver 160 outputs an ON-voltage LL of an emission control signal. Accordingly, the pixel circuit maintains the data voltage stored in the storage capacitor Cst in the first frame period during the second to 120th frame periods (2nd to 120th frames, about 1 second). The standby image displayed on the display panel 110 may be maintained during the second to 120th frame periods of 120 Hz.

As a result, the display panel 110 may have the effect of driving at a panel frequency of 1 Hz as displayed by a standby image of one frame per second. In the low-power drive mode, the power consumption of the display device may be reduced.

In an embodiment, when the driving mode is switched from the low power driving mode to the normal driving mode in accordance with the mode switching signal such as a user selection (Step S140), the timing controller 120 derives the data driving part 141, the scan driver 150, and the light emission driver 160 in the afterimage removal mode during/for a preset period (step S150).

The preset period may be preset according to the time during which the afterimage is visible when switching from the low-power drive mode to the normal drive mode. For example, when the time of the afterimage is 10 seconds, the preset period may be set to about 6 seconds to about 8 seconds.

Referring to FIG. 4C, in the afterimage removal mode, a frame period (corresponding to the panel drive frequency, for example, 120 Hz) may include an initialization period INP, an active period ACT, and a simultaneous light-emitting period SEP.

In the initialization period INP, the data driver 141 outputs (instances of) a reference voltage Vref to the data line(s) to initialize a threshold voltage of the first transistor(s) T1 of the pixel circuit(s). The reference voltage Vref may be the lowest level data voltage of the available data voltages. For example, the reference voltage Vref may be a white-level data voltage.

The scan driver 150 simultaneously outputs (instances of) the ON-voltage HL of the scan signal to the plurality of scan lines during the initialization period INP during which the data driver 140 outputs the reference voltage Vref.

The emission driver 160 outputs the ON-voltage LL of the emission control signal to a plurality of emission lines.

Accordingly, the threshold voltage of the first transistor T1 of the pixel circuit at the initialization period INP may be initialized by the reference voltage Vref. The first transistor T1 may initialize the shifted threshold voltage as the still image is displayed for a long time in the low-power drive mode.

According to an embodiment, in the initialization period INP, the second power source voltage ELVSS_H of high level is applied to the display panel 110. The second power source voltage of the high level, ELVSS_H, may be preset to a level that prevents current from flowing through the organic light emitting diode OLED.

Accordingly, even when the third transistor T3 is turned on, current may be prevented from flowing to the organic light emitting diode OLED by the second level power source ELVSS_H. The organic light emitting diode does not emit light because no driving current is applied to the OLED.

In the active period ACT, the data driver 141 outputs data voltages D1, D2, D3, . . . , DN for a horizontal line.

The scan driver 150 outputs the scan signals S1, S2, S3, . . . having an ON-voltage HL corresponding to the horizontal period 1H in which the data voltage of the horizontal line is outputted from the data driver 141. The second transistor T2 of the pixel circuit is turned on so that the data voltage may be applied to the control electrode of the first transistor T1.

According to an embodiment, in the active period ACT, a high level second power source voltage ELVSS_H is applied to the display panel 110. The second power source voltage of the high level ELVSS_H, may be preset to a level that prevents current from flowing through the organic light emitting diode OLED.

Accordingly, even when the third transistor T3 is turned on, the organic light emitting diode OLED does not emit light because the current is not applied to the OLED by the second power source voltage ELVSS_H of high level.

In the simultaneous light-emitting period SEP, the data driver 141 does not output a data voltage.

The scan driver 150 simultaneously outputs (instances of) the OFF-voltage LL of the scan signal to the plurality of scan lines.

The emission driver 160 outputs (instances of) the ON-voltage LL of the emission control signal to a plurality of emission lines.

According to an embodiment, in the simultaneous light-emitting period SEP, the display panel 110 is applied with a second power source voltage ELVSS lower than the first power source voltage ELVDD.

Accordingly, when the ON-voltage LL of the emission control signal is applied to the third transistor T3 to turn on, a current flows between the first power source voltage ELVDD and the second power source voltage ELVSS. The first transistor T1 is turned on based on the data voltage, and the driving current according to the gate-source voltage Vgs of the first transistor T1 flows to the anode electrode of the organic light emitting diode OLED.

Therefore, the plurality of horizontal lines (i.e., pixel rows) of the display panel 110 may simultaneously display a normal image in a normal drive mode using a simultaneous light-emitting mode.

The display device is driven in the afterimage removal mode for a preset period, for example, for a length in a range of 6 seconds to 8 seconds, and thereafter, as shown in FIG. 4A, the display device displays the normal image in the normal driving mode in which a frame period includes an active period and at least one vertical blank period VB1 and VB2 (Step S160).

According to an embodiment, the frame period of the afterimage removal mode may include a threshold voltage initialization period, a simultaneous light-emitting period for simultaneously writing the data of the normal image on the display panel, and an active period. The instantaneous afterimage corresponding to the standby image may be removed by driving the display device in the afterimage removal mode for a preset period when switching from the low power driving mode (for displaying a still image) to the normal driving mode (for displaying the normal image).

Hereinafter, same reference numerals may refer to the same or like parts described above, and detailed explanations may not be repeated.

Figure 5:
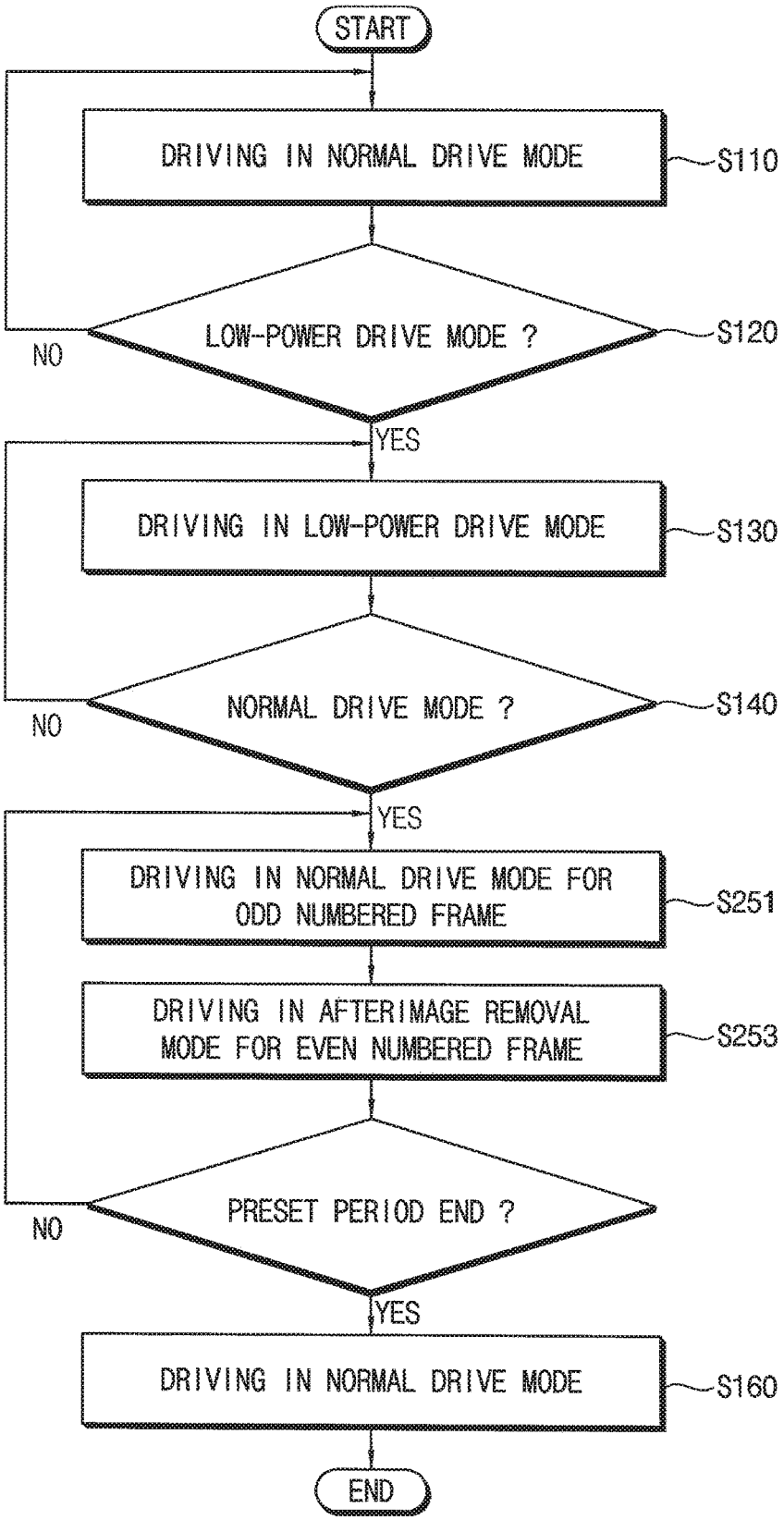
FIG. 5 is a flowchart illustrating a method of driving a display device according to one embodiment.
Figure 6A:
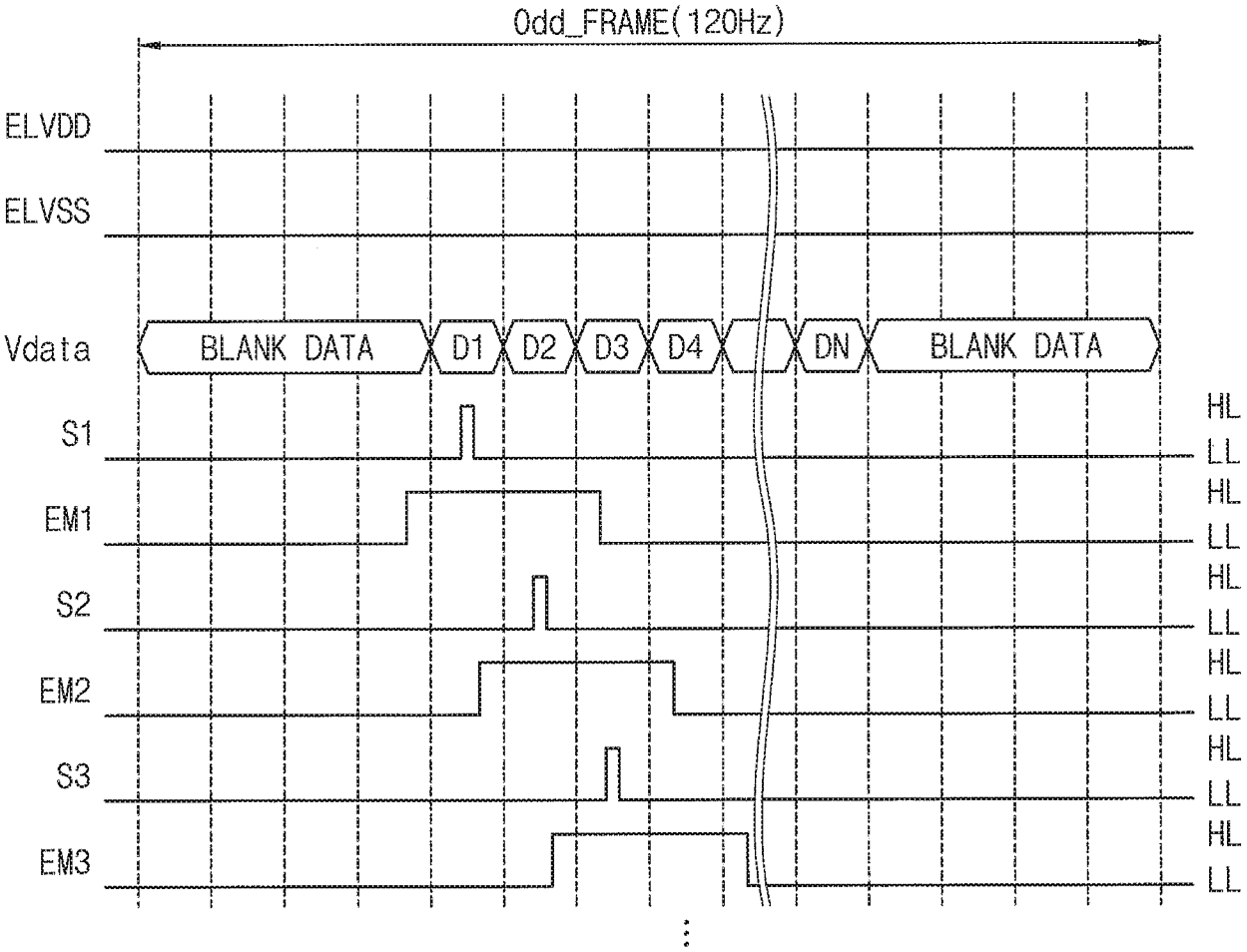
FIG. 6A and FIG. 6B are waveform diagrams illustrating a method of driving a display device according to one embodiment.
Figure 6B:
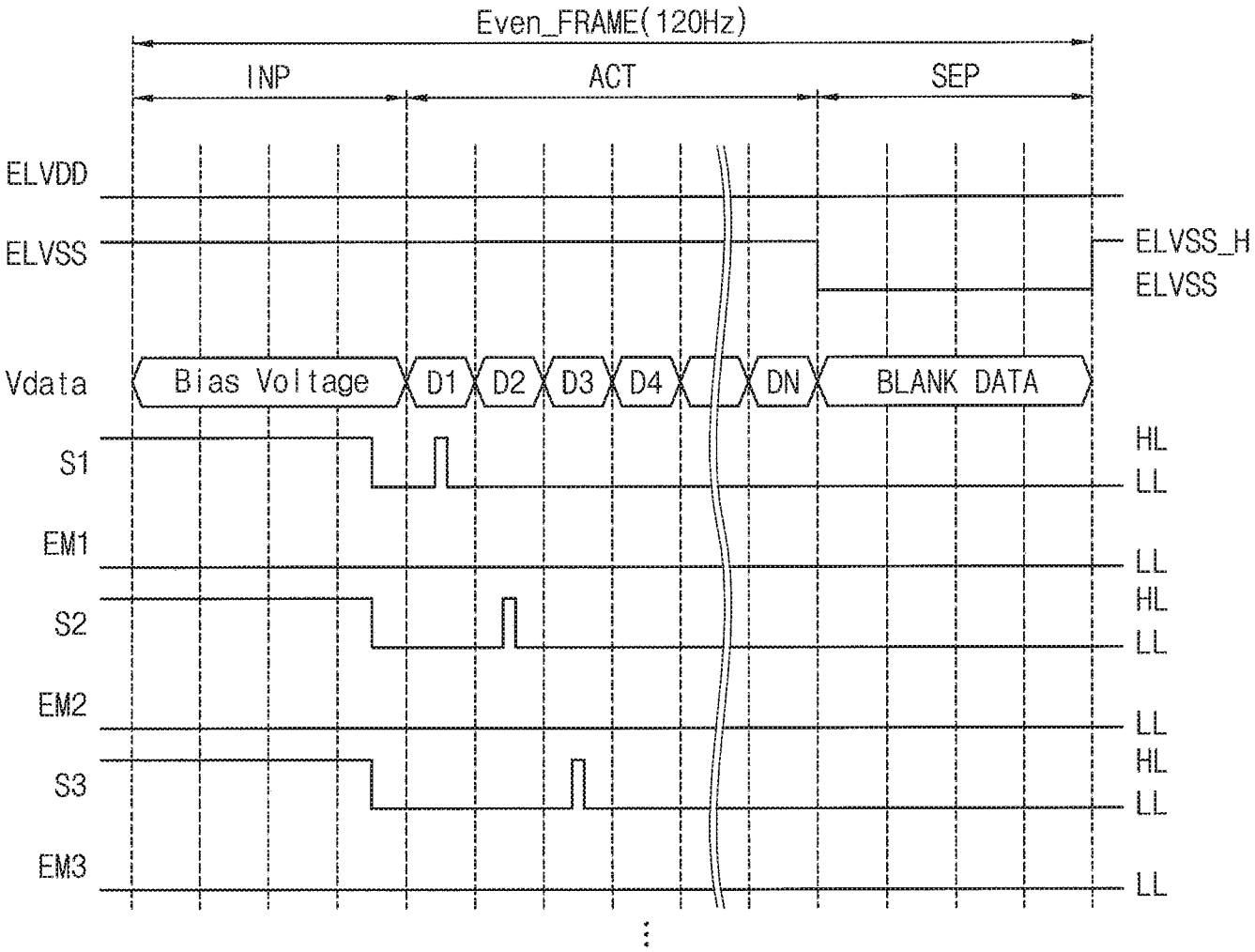

FIG. 5 is a flowchart diagram illustrating a method of driving a display device according to one embodiment. FIGS. 6A and 6B are waveform diagrams illustrating a method of driving a display device according to one embodiment.

Referring to FIGS. 1, 2, 5, and 4A, the timing controller 120 drives the data driver 141, the scan driver 150, and the emission driver 160 at a panel drive frequency in a normal drive mode to display a normal image on the display panel 110 (Step S110). The panel drive frequency is, for example, 120 Hz.

The frame period may include an active period ACT and at least one vertical blank period VB1 and VB2.

The data driver 141 outputs data voltages D1, D2, D3, . . . , DN for a horizontal line (i.e., a pixel row) in the active period ACT by a horizontal period and does not output a data voltage during the vertical blank period VB1 and VB2. Where, 'N' is the number of horizontal lines of the display panel.

The scan driver 150 outputs a scan signal S1, S2, S3, . . . , having an ON-voltage HL corresponding to the horizontal period 1H outputting the data voltage of the horizontal line from the data driver 141 and an OFF-voltage LL in the remaining period/time of the frame.

The emission driver 160 outputs an emission control signal EM1, EM2, EM3, . . . having an OFF-voltage HL corresponding to the horizontal period 1H in which the data voltage of the horizontal line is output from the data driver 141, and an ON-voltage LL during the remaining period of the frame.

As shown in FIG. 4A, in the normal drive mode, the plurality of horizontal lines of the display panel 110 may sequentially emit light to display a normal image.

When the drive mode of the display device is switched to the low-power drive mode to conserve power (Step S120), the display device displays a standby image on the display panel 110 (Step S130).

Referring to FIG. 4B, in the low-power drive mode, during a first frame period 1st Frame with 120 Hz of the panel drive frequency, the data driver 141, the scan driver 150, and the emission driver 160 display a standby image on the display panel 110 with a sequential light emitting mode.

Second to 120-th frame periods (for example, a 2nd Frame) with the panel drive frequency, for example, 120 Hz, the timing controller 120 drives the data driver 141, the scan driver 150 and the emission driver 160 to maintain the standby image displayed on the display panel 110. For example, the data driver 141 does not output a data voltage, the scan driver 150 outputs an OFF-voltage LL of a scan signal, and the emission driver 160 outputs an ON-voltage LL of an emission control signal. Accordingly, the pixel circuit maintains the data voltage stored in the storage capacitor Cst in the first frame period during the second to 120th frame periods (2nd to 120th frames, about 1 second). The standby image displayed on the display panel 110 may be maintained during the second to 120-th frame periods of 120 Hz.

The display panel 110 may have the effect of driving at a panel frequency of 1 Hz as displayed by a standby image of one frame per second. In the low-power drive mode, the power consumption of the display device may be reduced.

When the driving mode is switched from the low power driving mode to the normal driving mode in accordance with the mode switching signal such as a user selection (Step S140), the timing controller 120 alternately drives the data driver 141, the scan driver 150, and the light emission driver 160 by every frame in a normal drive mode and afterimage removal mode during/for a preset period (Steps S251 and S253).

Referring to FIG. 6A, the timing controller 120 displays a normal image on the display panel 110 in the normal image mode during an odd numbered frame period of the panel drive frequency.

For example, the odd numbered frame period of 120 Hz includes an active period ACT and at least one vertical blank period VB1 and VB2.

The data driver 141 outputs data voltages D1, D2, D3, . . . , DN for a horizontal line in the active period ACT by a horizontal period and does not output a data voltage during the vertical blank period VB1 and VB2. The scan driver 150 outputs a scan signal S1, S2, S3, . . . , having an ON-voltage HL corresponding to the horizontal period 1H outputting the data voltage of the horizontal line from the data driver 141 and an OFF-voltage LL in the remaining period/time of the frame. The emission driver 160 outputs an emission control signal EM1, EM2, EM3, . . . having an OFF-voltage HL corresponding to the horizontal period 1H in which the data voltage of the horizontal line is output from the data driver 141, and an ON-voltage LL during the remaining period/time of the frame. In the odd numbered frame period, the plurality of horizontal lines of the display panel 110 may display a normal image with a sequential light emitting mode (Step S251).

Referring to FIG. 6B, the timing controller 120 drives a normal image on the display panel 110 in an afterimage removal mode during an even numbered frame period of the panel drive frequency.

For example, the even numbered frame period of 120 Hz may include an initialization period INP, an active period ACT, and a simultaneous light-emitting period SEP.

In the initialization period INP, the data driver 141 outputs (instances of) a reference voltage Vref to the data line(s) for initializing the threshold voltage. The scan driver 150 simultaneously outputs (instances of) the ON-voltage HL of the scan signal to the plurality of scan lines. The emission driver 160 outputs (instances of) the ON-voltage LL of the emission control signal to a plurality of emission lines. The display panel 110 is supplied with a high level second power source voltage ELVSS_H. The second power source voltage of the high level ELVSS_H may be preset to a level that prevents current from flowing through the organic light emitting diode OLED.

Therefore, in the initialization period INP, the threshold voltage of the first transistor T1 of the pixel circuit is initialized by the reference voltage Vref, and the organic light emitting diode OLED does not emit light.

In the active period ACT, the data driver 141 outputs data voltages D1, D2, D3, . . . , DN for a horizontal line. The scan driver 150 outputs the scan signals S1, S2, S3, . . . , having an ON-voltage HL corresponding to the horizontal period 1H in which the data voltage of the horizontal line is outputted from the data driver 141. The display panel 110 is supplied with a high level second power source voltage ELVSS_H. The second power source voltage of the high level ELVSS_H may be preset to a level that prevents current from flowing through the organic light emitting diode OLED. The second transistor T2 of the pixel circuit is turned on so that the data voltage is applied to the control electrode of the first transistor T1 and the organic light emitting diode OLED does not emit light.

In the simultaneous light-emitting period SEP, the data driver 141 does not output a data voltage. The scan driver 150 simultaneously outputs (instances of) the OFF-voltage LL of the scan signal to the plurality of scan lines. The emission driver 160 outputs (instances of) the ON-voltage LL of the emission control signal to a plurality of emission lines.

Thus, the third transistor T3 is turned on, the first transistor T1 is turned on based on the data voltage, and the driving current according to the gate/source voltage Vgs of the first transistor T1 is applied to the anode electrode of the OLED of the organic light emitting diode OLED. Therefore, in the even numbered frame period, the display panel 110 may display a normal image by simultaneously emitting a plurality of horizontal lines (Step S253).

In the preset period, for example, a period in a range of 6 second to 8 second, the display device is driven in the normal drive mode during the odd numbered frame period and is driven in the afterimage removal mode during the even numbered frame period, and thus the instantaneous afterimage may be removed.

After the preset period, as shown in FIG. 4A, the display device displays the normal image in the normal driving mode in which a frame period includes an active period and at least one vertical blank period VB1 and VB2 (Step S160).

According to the embodiments, the instantaneous afterimage may be eliminated by initializing the threshold voltage and applying the simultaneous light-emitting mode when the drive mode is switched from the low-power drive mode to the normal drive mode.

An embodiment may be applied to a display device and/or an electronic device having the display device. For example, embodiments may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative and is not limiting. Although example embodiments have been described, many modifications are possible in the described embodiments without materially departing from the scope defined in the claims.

What is claimed is:

1. A display device comprising:

a plurality of data lines;

a plurality of scan lines electrically insulated from the plurality of data lines; and a plurality of pixel circuits, each of the pixel circuits comprising an organic light emitting diode, a first transistor, and a second transistor, wherein the first transistor is electrically connected to an anode electrode of the organic light emitting diode, wherein the second transistor is electrically connected to the first transistor, a scan line among the scan lines, and a data line among the data lines, wherein the second transistors of the pixel circuits are configured to respectively receive instances of a reference voltage from the plurality of data lines during a first period of a frame, wherein the second transistors of the pixel circuits are configured to respectively and simultaneously receive instances of a turn-on scan signal from the plurality of scan lines and turn on during the first period of the frame, wherein cathode electrodes of the organic light emitting diodes of the pixel circuits are configured to respectively receive instances of a turn-off voltage for the organic light emitting diodes of the pixel circuits to turn off during the first period of the frame, wherein an active period of the frame immediately follows the first period of the frame, wherein the second transistors of the pixel circuits are configured to respectively receive data voltages from the plurality of data lines during the active period of the frame, wherein at least one the data voltages is unequal to the reference voltage, and wherein the cathode electrodes of the organic light emitting diodes of the pixel circuits are configured to respectively continue receiving the instances of the turn-off voltage and remain turned off during the active period of the frame.

2. The display device of claim 1, comprising: a plurality of emission lines, wherein each of the pixel circuits further comprises a third transistor electrically connected to the first transistor and an emission line among the emission lines.

3. The display device of claim 2, wherein the third transistors of the pixel circuits are configured to respectively and simultaneously receive instances of a turn-on emission control signal from the plurality of emission lines and turn on during the first period of the frame.

4. The display device of claim 2, wherein a light-emitting period of the frame immediately follows the active period of the frame, wherein the cathode electrodes of the organic light emitting diodes of the pixel circuits are configured to respectively receive instances of a turn-on voltage during the light-emitting period, and wherein the third transistors of the pixel circuits are configured to respectively and simultaneously receive further instances of the turn-on emission control signal from the plurality of emission lines during the light-emitting period.

5. The display device of claim 4, wherein at least one of the first period of the frame and the light-emitting period of the frame is shorter than the active period of the frame.

6. A display device comprising:

a plurality of data lines;

a plurality of scan lines electrically insulated from the plurality of data lines; and a plurality of pixel circuits, each of the pixel circuits comprising an organic light emitting diode, a first transistor, and a second transistor, wherein the first transistor is electrically connected to an anode electrode of the organic light emitting diode, wherein the second transistor is electrically connected to the first transistor, a scan line among the scan lines, and a data line among the data lines, wherein the second transistors of the pixel circuits are configured to respectively receive instances of a reference voltage from the plurality of data lines during a first period of a frame, wherein the second transistors of the pixel circuits are configured to respectively and simultaneously receive instances of a turn-on scan signal from the plurality of scan lines and turn on during the first period of the frame, wherein cathode electrodes of the organic light emitting diodes of the pixel circuits are configured to respectively receive instances of a turn-off voltage for the organic light emitting diodes of the pixel circuits to turn off during the first period of the frame, wherein the display device is configured to operate in an afterimage removal mode for a preset period after operating in a power-saving drive mode and before operating in a normal drive mode, wherein power consumption of the display device in the power-saving drive mode is lower than power consumption of the display device in the normal drive mode, and wherein operations of the frame are repeated for frames during the preset period.

7. The display device of claim 1, wherein the display device is configured to operate in an afterimage removal mode for a preset period after operating in a power-saving drive mode, wherein power consumption of the display device in the power-saving drive mode is lower than power consumption of the display device in a normal drive mode, wherein operations of the frame are repeated for one of odd-numbered frames and even-numbered frames during the preset period, and wherein at least some operations of the frame are not performed for the other of the odd-numbered frames and the even-numbered frames during the preset period.

8. The display device of claim 2, wherein the first transistor and the third transistor are P-type transistors, and wherein the second transistor is an N-type transistor.

9. The display device of claim 2, further comprising: a plurality of sensing lines, wherein each of the pixel circuits further comprises a fourth transistor electrically connected to the anode electrode of the organic light emitting diode and a sensing line among the sensing lines.

10. The display device of claim 9, wherein the fourth transistor is an N-type transistor.

11. The display device of claim 9, further comprising:

a sensing part electrically connected to the sensing lines and generating sensing data by analog-to-digital conversion of sensing signals transmitted from the sensing lines.

12. A method of driving a display device, the display device comprising a plurality of data lines, a plurality of scan lines, and a plurality of pixel circuits, each of the pixel circuits comprising an organic light emitting diode, a first transistor, and a second transistor, the method comprising:

providing instances of a reference voltage through the plurality of data lines to the second transistors of the pixel circuits during a first period of a frame;

simultaneously providing instances of a turn-on scan signal through the plurality of scan lines to the second transistors of the pixel circuits to turn on the second transistors of the pixel circuits during the first period of the frame;

applying instances of a turn-off voltage to cathode electrodes of the organic light emitting diodes of the pixel circuits to turn off the organic light emitting diodes of the pixel circuits during the first period of the frame;

providing data voltages through the plurality of data lines to the second transistors during an active period of the frame, wherein the active period immediately follows the first period, and wherein at least one the data voltages is unequal to the reference voltage; and providing the instances of the turn-off voltages to the cathode electrode of the organic light emitting diodes of the pixel circuits during the active period of the frame.

13. The method of claim 12, wherein the display device further comprises a plurality of emission lines, wherein each of the pixel circuits further comprises a third transistor electrically connected to the first transistor and an emission line among the emission lines, wherein the method further comprises simultaneously providing instances of a turn-on emission control signal through the plurality of emission lines to the third transistors of the pixel circuits to turn on the third transistors of the pixel circuits during the first period of the frame.

14. The method of claim 13, further comprising:

providing instances of a turn-on voltage to the cathode electrodes of the organic light emitting diodes of the pixel circuits during a light-emitting period of the frame, wherein the light-emitting period of the frame immediately follows the active period of the frame; and simultaneously providing instances of a turn-on emission control signal through the plurality of emission lines to the third transistors of the pixel circuits.

15. The method of claim 14, wherein at least one of the first period of the frame and the light-emitting period of the frame is shorter than the active period of the frame.

16. The method of claim 12, wherein the display device is configured to operate in an afterimage removal mode for a preset period after operating in a power-saving drive mode and before operating in a normal drive mode, wherein power consumption of the power-saving drive mode is lower than power consumption of the normal drive mode, and wherein operations of the frame are repeated for frames during the preset period.

17. The method of claim 12, wherein the display device is configured to operate in an afterimage removal mode for a preset period after operating in a power-saving drive mode, wherein power consumption of the power-saving drive mode is lower than power consumption of a normal drive mode, wherein operations of the frame are repeated for one of odd-numbered frames and even-numbered frames during the preset period, and wherein at least some operations of the frame are not performed for the other of the odd-numbered frames and the even-numbered frames during the preset period.

18. The method of claim 13, wherein the first transistor and the third transistor are P-type transistors, and wherein the second transistor is an N-type transistor.

* * * * *